US012654806B1

(12) United States Patent
Ezra

(10) Patent No.: US 12,654,806 B1
(45) Date of Patent: Jun. 16, 2026

(54) BOAT WAKE ENHANCING DEVICE

(71) Applicant: Eyal Ezra, Upper Montclair, NJ (US)

(72) Inventor: Eyal Ezra, Upper Montclair, NJ (US)

( * ) Notice: Subject to any disclaimer, the term of this patent is extended or adjusted under 35 U.S.C. 154(b) by 0 days.

(21) Appl. No.: 19/358,747

(22) Filed: Oct. 15, 2025

(51) Int. Cl.

| | |
|---|---|
| ***B63B 1/28*** | (2006.01) |
| ***B63B 1/30*** | (2006.01) |
| ***B63B 34/70*** | (2020.01) |
| ***B63B 79/40*** | (2020.01) |

(52) U.S. Cl.
CPC ..... *B63B 1/286* (2013.01); *B63B 1/30* (2013.01); *B63B 34/70* (2020.02); *B63B 79/40* (2020.01)

(58) Field of Classification Search
CPC B63B 1/30; B63B 1/286; B63B 79/40; B63B 34/70; B63B 34/75
See application file for complete search history.

(56) References Cited

U.S. PATENT DOCUMENTS

| | | | | |
|---|---|---|---|---|
| 3,150,626 | A * | 9/1964 | Irgens | B63B 1/26 114/291 |
| 3,456,611 | A * | 7/1969 | Johnson | B63B 1/30 114/275 |
| 4,896,622 | A * | 1/1990 | Thomas | B63B 39/061 114/271 |
| 5,549,071 | A | 8/1996 | Pigeon et al. | |
| 6,234,099 | B1 | 5/2001 | Jessen et al. | |
| 9,545,977 | B1 | 1/2017 | Swiatek | |
| 9,611,006 | B1 | 4/2017 | Miller et al. | |
| 11,370,508 | B1 | 6/2022 | Dugger et al. | |
| 11,518,482 | B1 * | 12/2022 | Dugger | B63B 1/285 |
| 2014/0026799 | A1 | 1/2014 | Kalil | |
| 2016/0221642 | A1 | 8/2016 | Naples | |
| 2017/0015386 | A1 | 1/2017 | Orr | |
| 2021/0354793 | A1 | 11/2021 | Wang | |
| 2022/0089258 | A1 | 3/2022 | Uggeri et al. | |
| 2022/0153391 | A1 | 5/2022 | Sheedy et al. | |
| 2024/0132184 | A1 | 4/2024 | Ritter | |
| 2024/0294236 | A1 | 9/2024 | Uggeri et al. | |

* cited by examiner

*Primary Examiner* — Marc Burgess
(74) *Attorney, Agent, or Firm* — Goldstein Law Offices, P.C.

(57) ABSTRACT

A boat wake enhancing device configured to create and control wakes generated by a boat having a hull with a bottom, the bottom of the hull have at least two apertures defining two interior cavities comprising a left assembly, a right assembly, and at least two tabs. The assemblies mounted to the bottom of the hull, each including a top end, a bottom end, a first actuator arm, and a second actuator arm. The actuator arms configured to translate between an open position and a closed position. The tabs coupled to the right assembly and the left assembly include a downturned position, a neutral position, and an upturned position. These positions create downforce, lift, or stabilization upon the boat thereby creating and controlling the wake. The tabs retract into the interior cavities when in the closed position, the tabs extend below the interior cavities when in the open position.

15 Claims, 10 Drawing Sheets

BOAT WAKE ENHANCING DEVICE

TECHNICAL FIELD

The present disclosure relates generally to a boat wake enhancing device. More particularly, the present disclosure relates to a boat wake enhancing device which efficiently creates and enhances wakes created by a boat for wake boarding and related activities.

BACKGROUND

Wake boarding, wake surfing, and other wake related activities have long been a favorite pastime activity. Moreover, participants of such activities have long recognized the importance of easily enhancing and/or controlling the wake. However, traditional boat wake enhancing devices do not address these concerns. Indeed, traditional boat wake enhancing devices may be detrimental as such devices are often difficult to use and are prone to leaks or failure.

Currently, traditional boat wake enhancing devices fail to address the need of easy operation and efficient enhancement and creation of wakes. These boat wake enhancing devices typically utilize a ballast system to create and enhance the wake. Ballast systems frequently cause leaking, are difficult to fully drain, and are difficult to fully control therefore making it challenging to achieve the desired wake. Furthermore, traditional boat wake enhancing devices are often heavy which may make it more difficult for the boat to achieve a higher speed and requires greater fuel consumption. While traditional boat wake enhancing devices may be suitable for the particular purpose employed, or for general use, they would not be suitable for the purpose of the present disclosure hereafter.

Accordingly, there is a need for a boat wake enhancing device which is easily operable and efficiently creates and enhances wakes. There is also a need for a boat wake enhancing device which does not utilize a ballast system, thereby making it easier to control the size of the wake. Such a boat wake enhancing device would provide an easy and efficient means to create and control wakes for wake boarding activities. Such a boat wake enhancing device would also eliminate the additional challenges traditional boat wake enhancing devices pose, such as leaking, greater fuel consumption, and speed restrictions.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

One aspect of an example embodiment in the present disclosure is to provide a boat wake enhancing device which enables easy operation and eliminates the challenges a ballast system poses. Such a boat wake enhancing device will provide an efficient means to create and control the size and location of a wake and eliminates the additional challenges traditional boat wake enhancing devices pose, such as leaking, greater fuel consumption, and speed restrictions. Accordingly, the present disclosure provides a boat wake enhancing device comprising a left assembly, a right assembly, and at least two tabs.

The boat wake enhancing device is generated by a boat having a deck and a hull with a bottom, the bottom of the hull includes at least two apertures extending inwardly towards the deck defining at least two interior cavities. The left assembly and the right assembly are mounted to the bottom of the hull. The left assembly is mounted toward the port side of the boat and the right assembly is mounted toward the starboard of the boat. In embodiments, the left assembly and the right assembly are substantially identical. The left assembly and the right assembly each include a first actuator arm and a second actuator arm configured to translate the left assembly and the right assembly between an open position and a closed position. The open position enables the tabs to be positioned below the hull, submerged in the water ready for use. The closed position enables the tabs to be positioned out of the water when not in use. The left assembly and the right assembly each include a top end and a bottom end. The top ends of the left assembly and the right assembly are mounted to the hull of the boat and the bottom ends of the left assembly and the right assembly are coupled to the tabs. The interior cavities each comprise a left side wall, a right side wall, a front wall, and a back wall. The left side wall is parallel to the right side wall and the side walls interconnect the front wall and the back wall. Each side wall includes a slot configured to aid in translating the left assembly and the right assembly between the open position and the closed position. The slots comprise a cavity defining a track with a front end and a back end opposite the front end. The right assembly and the left assembly are housed within the interior cavities, such that the top ends of the right assembly and the left assembly are mounted to the hull of the boat within the interior cavities. In embodiments, when the left assembly and the right assembly are in the closed position, the entire left assembly, the right assembly, and the tabs are fully housed within the interior cavities. In embodiments, when the left assembly and the right assembly are in the open position, the left assembly and the right assembly are partially housed within the interior cavities and the tabs and bottom ends of the right assembly and the left assembly are positioned outside of the interior cavities below the hull, submerged in the water.

The tabs are configured to create or enhance the wake and comprise a downturned position, a neutral position, and an upturned position. The first tab and the second tab are substantially identical. The tabs each include a top surface, a bottom surface opposite the top surface, a left side wall, and a right side wall parallel to the left side wall. The side walls extend perpendicularly between the top surface and the bottom surface. The tabs further include a first region and a second region. The first regions are closer in distance to the bow of the boat and the second regions are closer in distance to the stern of the boat. The tabs include an apex and are curved downward therefrom. The tabs are coupled to the left assembly and the right assembly at the apex and curve downwardly, outward from the apex such that the first regions and the second regions are the lowest point of the tabs when positioned in the neutral position. In embodiments, the tabs may comprise a foiled shape. In this way, the first regions comprise a rounded front edge and the second regions comprise a tail with a pointed edge. In embodiments, the rounded front edges include a greater height than the tail.

The top surfaces curve downwardly from the apex between the rounded front edges and the tails. The bottom surfaces taper between the rounded front edges and the tails in a substantially linear fashion. This enables the tabs to efficiently create lift and downforce upon the boat, thereby enhancing control of the wakes.

In embodiments, the first actuator arm and the second actuator arm of the left assembly are identical to the first actuator arm and the second actuator arm of the right assembly, respectively. The first actuator arm and the second actuator arm of the right assembly are substantially identical. The first actuator arm and the second actuator arm translate in tandem between the open position and the closed position. The first actuator arm and the second actuator arm each include a group of arms and a group of pistons. In embodiments, the group of arms each comprise a first arm, a second arm, and a third arm, each of which include an upper end and a lower end. The lower end of the first arm is coupled to the tab and extends upwardly, perpendicular from the top surface of the tab. The lower end of the second arm is coupled to the upper end of the first arm and the upper end of the second arm is coupled to a center region of the third arm. The third arm extends between the back end of the slot and a first piston. In embodiments, the group of pistons comprise the first piston and a second piston, each of which include a first end and a second end. The second end of the first piston is coupled to the lower end of the third arm. The second end of the second piston is coupled to the upper end of the first arm and the first end of the second piston is coupled to a middle region of the second arm.

In embodiments, the right assembly and the left assembly further include a group of horizontal arms configured to attach the assemblies to the boat and aid in translating the assemblies between the open and closed position. The group of horizontal arms of the left assembly are identical to the group of horizontal arms of the right assembly. In embodiments, the group of horizontal arms comprise a first horizontal arm, a second horizontal arm, and a third horizontal arm. The first horizontal arm extends perpendicularly between the left side wall and the right side wall of the first interior cavity. The first ends of the first pistons are coupled to the first horizontal arm. The second horizontal arm extends perpendicularly between the first slot and the second slot, such that the second horizontal arm is fastened to the tracks of the first slot and the second slot. The upper ends of the third arms are coupled to the second horizontal arm. In this way, as the third arms translate between the open position and the closed position, the second horizontal arm translates accordingly and simultaneously within the tracks. The third horizontal arm extends perpendicularly between the left side wall and the right side wall of the first interior cavity. The first ends of the second pistons and the middle region of the second arms are coupled to the third horizontal arm.

The left assembly is substantially identical to the right assembly. The first actuator arm and the second actuator arm of the left assembly are identical to the first actuator arm and the second actuator arm of the right assembly. In this way, the first actuator arm and the second actuator arm of the left assembly each comprises a group of arms and a group of pistons identical in make and configuration of the group of arms and the group of pistons of the first actuator arm and the second actuator arm of the right assembly. The left assembly includes a group of horizontal arms identical in make and configuration of the group of horizontal arms of the right assembly. In this way, the left assembly appears and performs identically to the right assembly.

In operation of embodiments, the boat wake enhancing device is engaged by translating the left assembly and the right assembly from the closed position to the open position. The first actuator arm and the second actuator arm of the right assembly transition from the closed position to the open position simultaneously and in identical manners. To transition the first actuator arm of the right assembly from the closed position to the open position, the second end of the first piston translates upwardly, pivoting upwardly around the first horizontal arm, thereby engaging the third arm. This translates the lower end of the third arm upwardly. In this way, the upper end of the third arm is pushed towards the stern of the boat, thereby causing the second horizontal arm to translate backwards, towards the stern of the boat. The second horizontal arm translates across the track of the slot, towards the back end of the slot. This causes the lower end of the second arm to translate downward until the lower end of the second arm is substantially perpendicular to the first arms. This translates the first arms and the tab downward, into the water below the interior cavity, thereby positioning the wake board device into the open position. The first actuator arm and the second actuator arm of the left assembly transition from the closed position to the open position in the same manner as the first actuator arm and the second actuator arm of the right assembly.

In operation of embodiments, the boat wake enhancing device is disengaged by translating the right assembly and the left assembly from the open position to the closed position. The first actuator arm and the second actuator arm of the right assembly transition from the open position to the closed position simultaneously and in identical manners. To transition the first actuator arm of the right assembly from the open position to the closed position, the second end of the first piston translate downwardly, pivoting downwardly around the first horizontal arm, thereby engaging the third arm. This translates the lower end of the third arm downward. In this way, the upper end of the third arm is pulled towards the bow of the boat, thereby causing the second horizontal arm to translate forward, towards the bow of the boat. The second horizontal arm translates across the track of the slot, towards the front end of the slot. This causes the lower end of the second arm to translate upward until the lower end of the first arm and the first tab are entirely housed within the first interior cavity. This positions the boat wake enhancing device into the closed position. The first actuator arm and the second actuator arm of the left assembly transition from the open position to the closed position in the same manner as the first actuator arm and the second actuator arm of the right assembly.

In the open position, the tabs may translate between the neutral position, the downturned position, and the upturned position. The neutral position enables the boat wake enhancing device to better stabilize the boat. In this position, the first arms are substantially perpendicular to the second arms. The tab is positioned directly below the boat with the apex substantially parallel to the deck of the boat. The downturned position enables the boat wake enhancing device to create additional downforce on the stern of the boat which results in the stern being pulled further downward into the water and the bow being pushed further upward out of the water. This creates additional water displacement around the stern of the boat thereby creating larger wakes for wake boarding activities. In this position, the first arms are angled outwardly away from the second arms, towards the stern of the boat. The upturned position enables the boat wake enhancing device to create additional lift on the stern of the boat which results in the stern of the boat being pushed further upward out of the water and the bow being pulled further downward into the water. This offsets part of the weight in the stern of the boat which creates smaller wakes for wake boarding activities. In this position, the first arms are angled inwardly towards the second arms and the bow of the boat.

The first actuator arm of the right assembly transitions into the downturned position by first engaging the second piston such that the second piston retracts toward the bow of the boat thereby causing the upper end of the first arm to pivot inwardly with the second end of the second piston. This translates the first arm backwards, toward the stern of the boat such that the upper end of the first arm translates forward towards the bow of the boat and the lower end of the first arm translates backwards toward the stern of the boat. In this way, the tab translates backwards toward the stern of the boat and is angled downward, such that the first region is positioned lower than the second region. This downturned position enables the current of the water to push onto the top surface of the tab, this creates downforce which pulls the stern of the boat downward deeper into the water. The first actuator arm of the right assembly transitions into the upturned position by first engaging the second piston such that the second piston protracts toward the stern of the boat thereby causing the upper end of the first arm to pivot outwardly with the second end of the second piston. This translates the first arm forward, toward the bow of the boat such that the upper end of the first arm translates backwards toward the stern of the boat and the lower end of the first arm translates forwards toward the bow of the boat. In this way, the tab translates forward towards the bow of the boat and is angled upward, such that the second region is positioned lower than the first region. This upturned position enables the current of the water to push onto the bottom surface of the tab, this creates lift which pushes the stern of the boat upward towards the surface of the water.

The first actuator arm of the right assembly transitions into the neutral position by engaging the second piston such that the second piston protracts towards the stern or retracts towards the bow, thereby causing the upper end of the first arm to pivot with the second end of the second piston. This translates the first arm to be perpendicular to both the lower end of the second arm and the apex of the tab. In this way, the tab translates so the apex is parallel with the deck of the boat and the first region and the second region of the tab are positioned at substantially the same depth. This neutral position enables the current of the water to evenly pass over the top surface of the tab and beneath the bottom surface of the tab, thereby enabling the tab to better stabilize the boat. The second actuator arm of the right assembly transitions between the downturned position, the neutral position, and the upturned position in an identical manner to the first actuator arm of the right assembly. The first actuator arm and the second actuator arm of the left assembly and the second tab transition between the downturned position, the neutral position, and the upturned position in an identical manner to the first actuator arm and the second actuator arm of the right assembly and the first tab.

In operation of embodiments, both the right assembly and the left assembly are deployed to the same position when in use. In other embodiments, the right assembly and the left assembly are deployed to different positions when in use. In embodiments, the boat wake enhancing device comprises any material which does not corrode or rust.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

Figure 1:
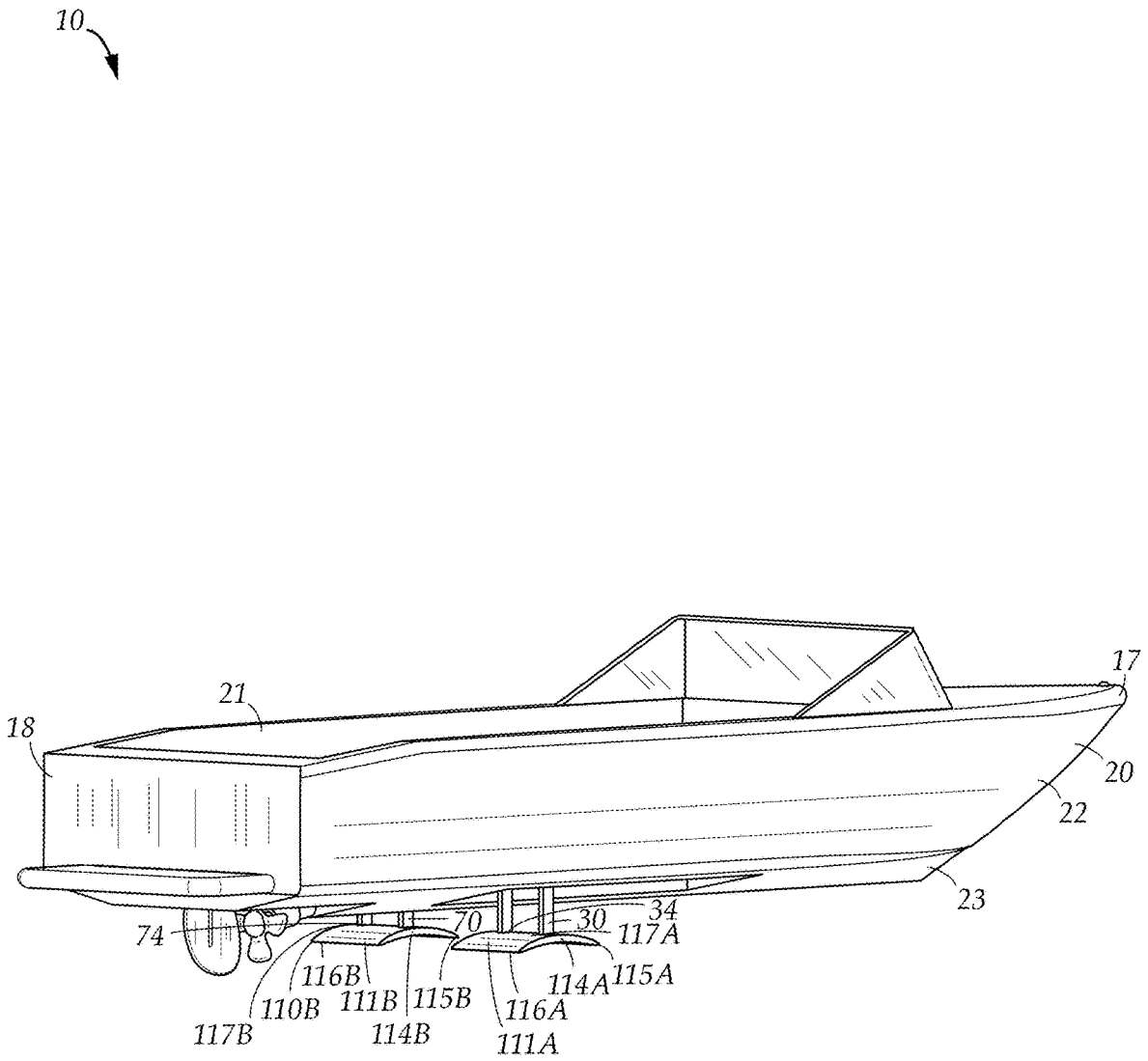
FIG. 1 shows a perspective view of the boat wake enhancing device, illustrating the boat wake enhancing device mounted to the hull of a boat in the open position in accordance with one embodiment of the present disclosure.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

As discussed above, wake boarding, wake surfing, and other wake related activities have long been a favorite pastime activity. Participants of such activities have long recognized the importance of easily enhancing and controlling the wake. Current products typically utilize a ballast system and fail to address the need of easy operation and control. These traditional boat wake enhancing devices pose additional challenges such as leaking, greater fuel consumption, and speed restrictions. While various attempts have been made to address these issues, these solutions are impractical. The embodiments herein address these issues and other issues.

Referring to FIG. 1, FIG. 2, FIG. 3, FIG. 4, FIG. 5A, FIG. 5B, FIG. 9, and FIG. 10, the present disclosure provides a boat wake enhancing device 10 which provides an efficient means to create and control the size and location of a wake and enables easy operation. The boat wake enhancing device 10 is generated by a boat 20 having a deck 16 and a hull 23 with a bottom, the bottom of the hull 23 includes at least two apertures 24A, 24B extending inwardly towards the deck 16 defining at least two interior cavities 25A, 25B. The boat wake enhancing device 10 comprises a right assembly 30, a left assembly 70, and at least two tabs 110A, 110B. In embodiments, the right assembly 30 and the left assembly 70 are substantially identical. The right assembly 30 and the left assembly 70 are mounted to the bottom of the hull 23 between the stern 18 and the midpoint of the stern 18 and the bow 17. The right assembly 30 is mounted toward the starboard 22, or right side, of the boat 20. The left assembly 70 is mounted toward the port side 21, or left side, of the boat 20. The left assembly 70 and the right assembly 30 each include a first actuator arm 31, 71 and a second actuator arm 32, 72 configured to translate the right assembly 30 and the left assembly 70 between an open position 12 and a closed position 11. The open position 12 enables the tabs 110A, 110B to be positioned below the hull 23, submerged in the water ready for use. The closed position 11 enables the tabs 110A, 110B to be positioned out of the water when not in use. The right assembly 30 and the left assembly 70 each include a top end 33, 73 and a bottom end 34, 74 opposite the top end 33, 73. In embodiments, the top ends 33, 73 of the right assembly 30 and the left assembly 70 are mounted to the hull 23 of the boat 20. In embodiments, the bottom end 34 of the right assembly 30 is coupled to the first tab 110A and the bottom end 74 of the left assembly 70 is coupled to the second tab 110B.

Referring now to FIG. 5A, FIG. 5B, FIG. 6A, and FIG. 6B, while continuing to refer to FIG. 1, FIG. 2, FIG. 3, FIG. 4, and FIG. 9, in embodiments, the first interior cavity 25A is configured to house the right assembly 30, the second interior cavity 25B is configured to house the left assembly 70. The interior cavities 25A, 25B each comprise a left side wall 26A, 26B, a right side wall 27A, 27B parallel to the left side wall 26A, 26B, a front wall 28A, 28B, and a back wall 29A, 29B parallel to the front wall 28A, 28B. The left side walls 26A, 26B and the right side walls 27A, 27B interconnect the front walls 28A, 28B and the back walls 29A, 29B. Each side wall 26A, 26B, 27A, 27B includes a slot 51A, 51B, 91A, 91B configured to aid in translating the left assembly 70 and the right assembly 30 between the open position 12 and the closed position 11. The slots 51A, 51B, 91A, 91B each comprise a cavity 52 defining a track 55 with a front end 53 and a back end 54 opposite the front end 53. In embodiments, the top end 33 of the right assembly 30 is mounted to the hull 23 within the first interior cavity 25A. In embodiments, the top end 73 of the left assembly 70 is mounted to the hull 23 within the second interior cavity 25B. In embodiments, when the left assembly 70 and the right assembly 30 are in the open position 12, the right assembly 30 and the left assembly 70 are partially housed within the interior cavities 25A, 25B and the tabs 110A, 110B and the bottom ends 34, 74 of the right assembly 30 and the left assembly 70 are positioned outside of the interior cavities 25A, 25B below the hull 23 of the boat 20, submerged in the water. In embodiments, when the left assembly 70 and the right assembly 30 are in the closed position 11, the right assembly 30 and the left assembly 70 and the tabs 110A, 110B are fully housed within the interior cavities 25A, 25B.

The tabs 110A, 110B are configured to create or enhance the wake comprising a downturned position 13, a neutral position 14, and an upturned position 15. The first tab 110A and the second tab 110B are substantially identical. The first tab 110A and the second tab 110B each include a top surface 111A, 111B, a bottom surface 112A, 112B opposite the top surface 111A, 111B, a left side wall 113A, 113B, and a right side wall 114A, 114B parallel the left side wall 113A, 113B. The right side walls 114A, 114B and the left side walls 113A, 113B extend perpendicularly between the top surfaces 111A, 111B and the bottom surfaces 112A, 112B. The tabs 110A, 110B each further include a first region 115A, 115B and a second region 116A, 116B. The first regions 115A, 115B are closer in distance to the bow 17 of the boat 20 and the second regions 116A, 116B are closer in distance to the stern 18 of the boat 20. The tabs 110A, 110B are curved downward such that the tabs 110A, 110B include an apex 117A, 117B. In embodiments, the first tab 110A and the second tab 110B are coupled to the left assembly 30 and the right assembly 70, respectively, at the apex 117A, 117B. In embodiments, the tabs 110A, 110B curve downwardly from the apex 117A, 117B. In this way, the tabs 110A, 110B curve downwardly, outward from the apex 117A, 117B such that the first regions 115A, 115B and the second regions 116A, 116B are the lowest point of the tabs 110A, 110B when positioned in the neutral position 14.

Figure 6A:
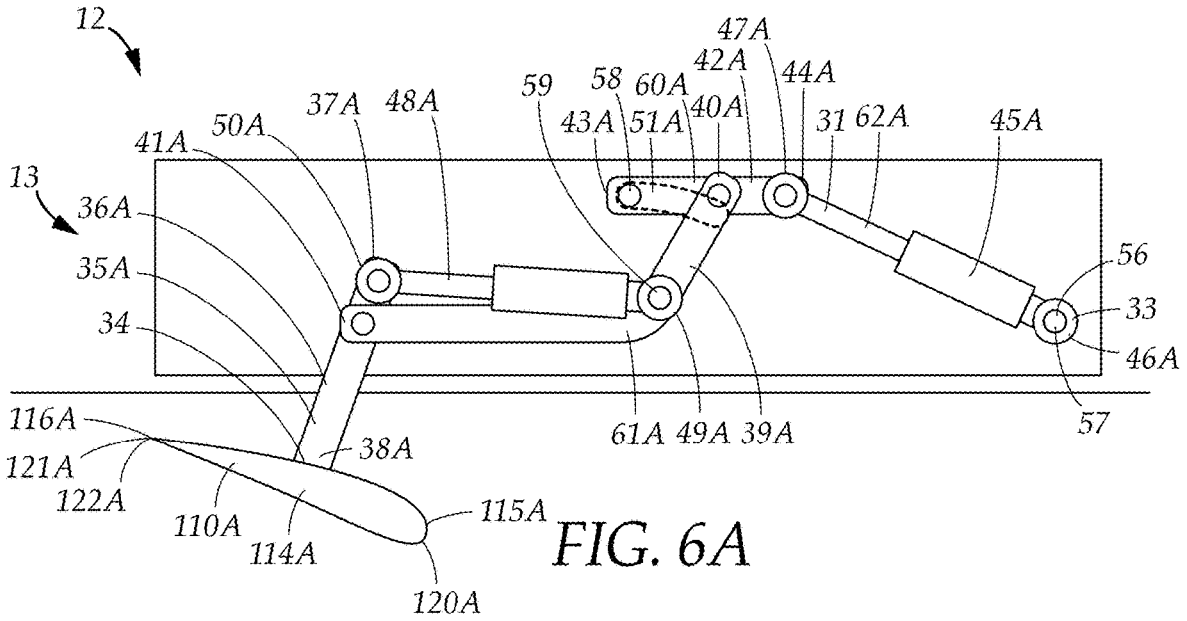
FIG. 6A shows a side plan view of the boat wake enhancing device, illustrating the first actuator arm of the right assembly attached to the hull of a boat in the downturned position in accordance with one embodiment of the present disclosure.
Figure 6B:
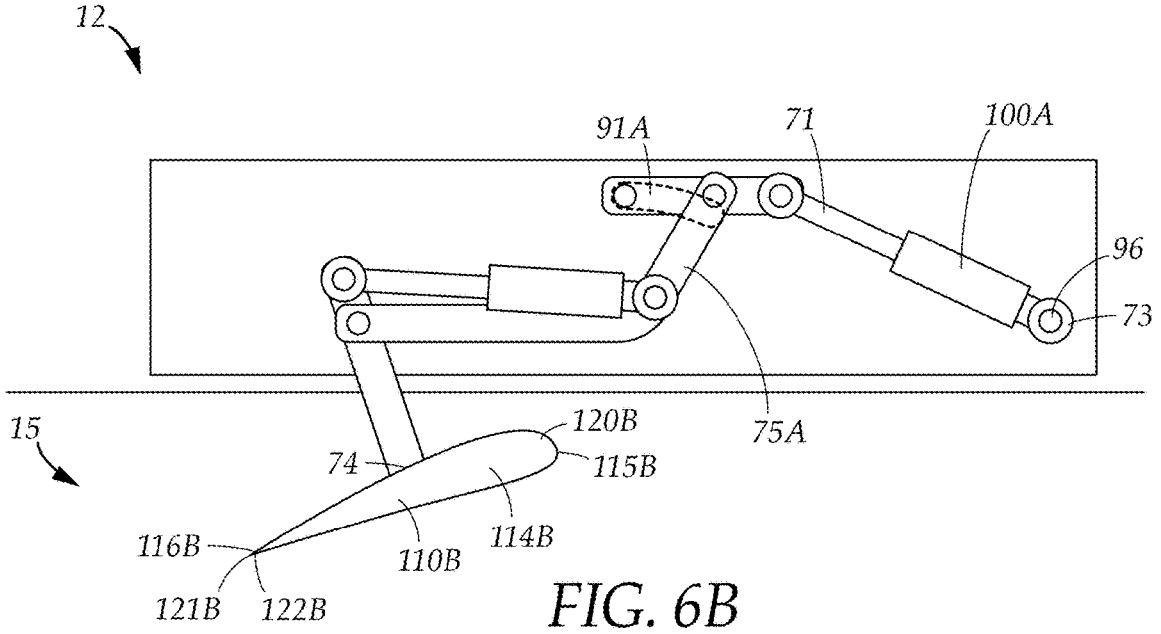
FIG. 6B shows a side plan view of the boat wake enhancing device, illustrating the first actuator arm of the left assembly attached to the hull of a boat in the upturned position in accordance with one embodiment of the present disclosure.
Figure 8A:
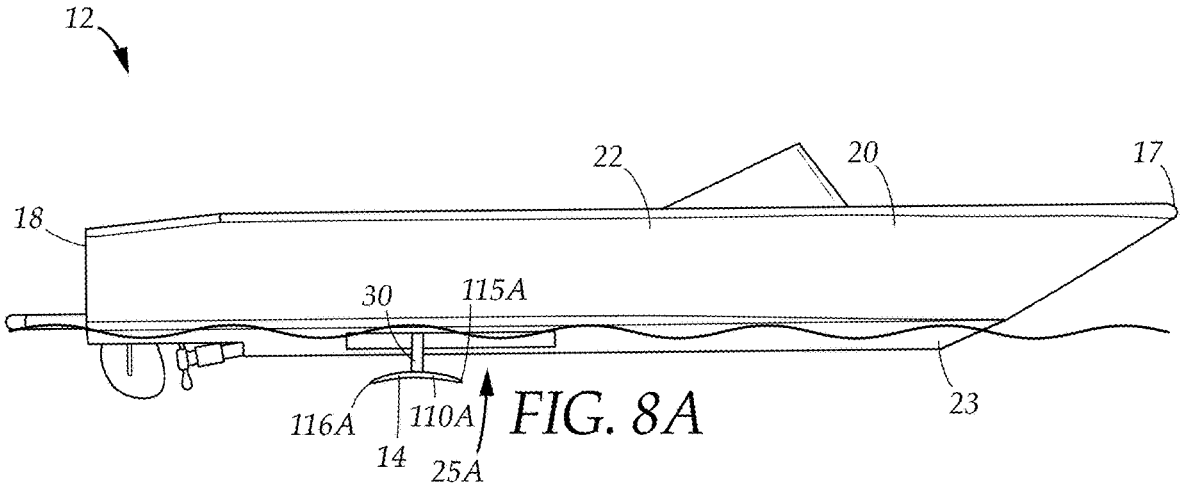
FIG. 8A shows a side view of the boat wake enhancing device, illustrating the right assembly and the left assembly in the neutral position in accordance with one embodiment of the present disclosure.
Figure 8B:
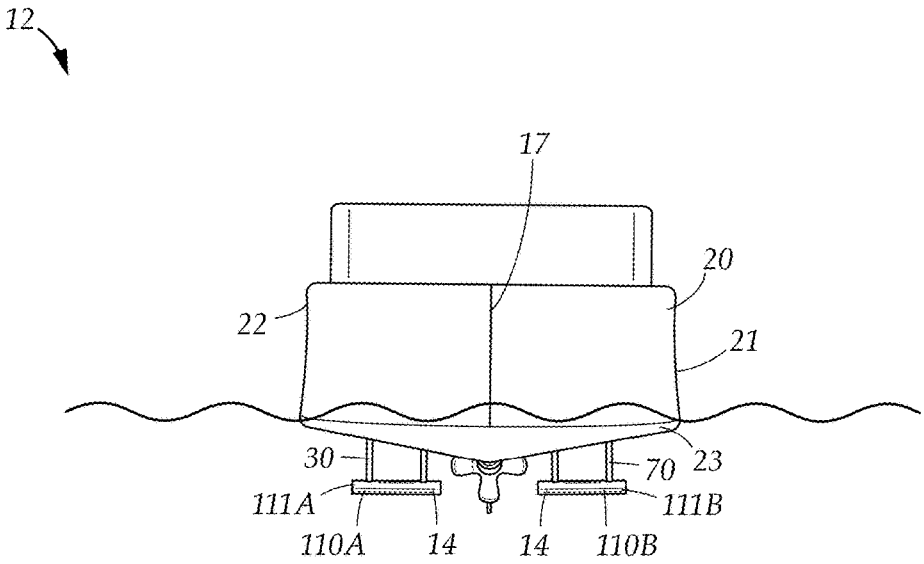
FIG. 8B shows a front view of the boat wake enhancing device, illustrating the right assembly and the left assembly in the neutral position in accordance with one embodiment of the present disclosure.
Figure 9:
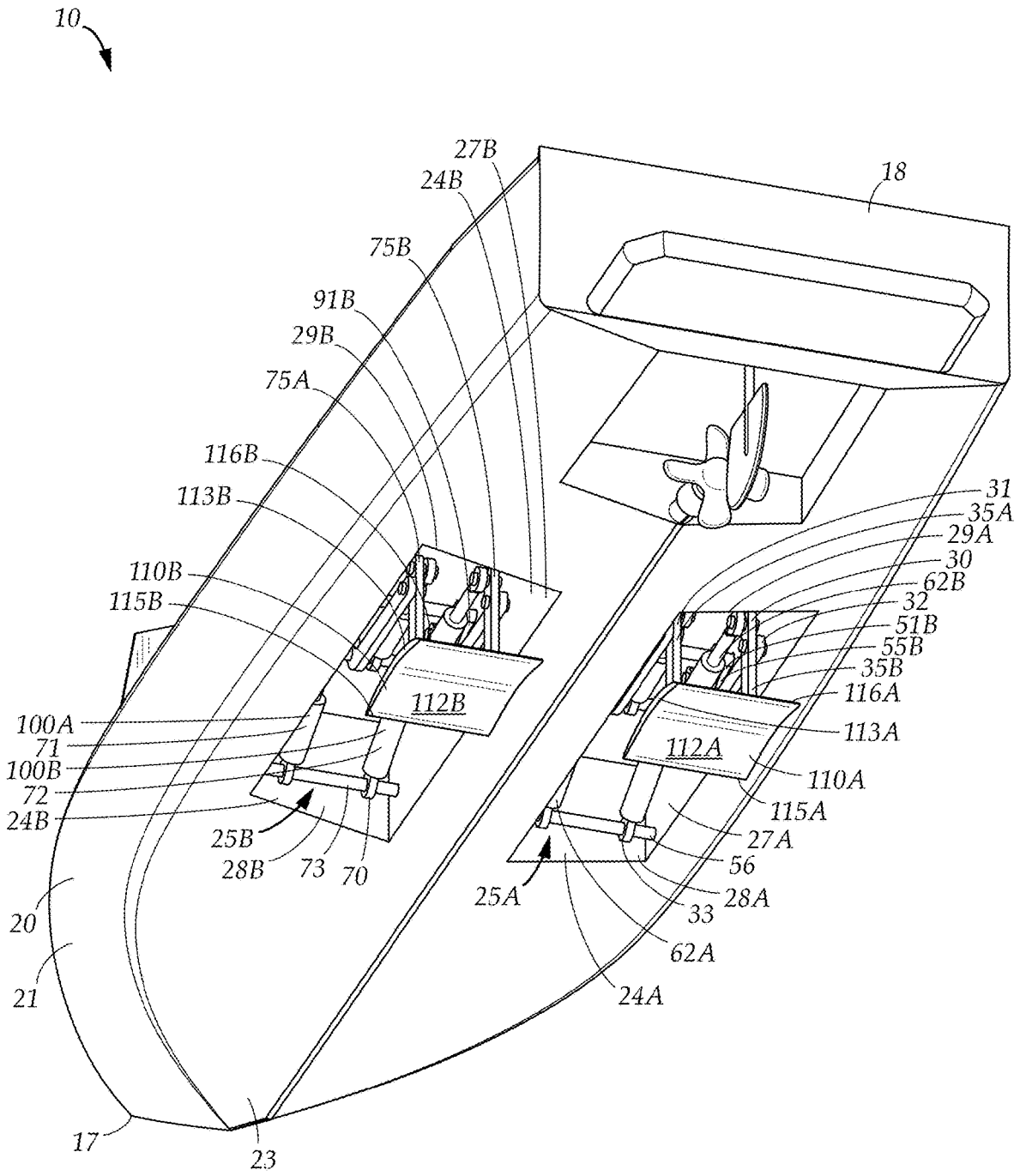
FIG. 9 shows a bottom perspective view of the boat wake enhancing device, illustrating the boat wake enhancing device mounted to the hull of a boat in an open position in accordance with one embodiment of the present disclosure.
Figure 10:
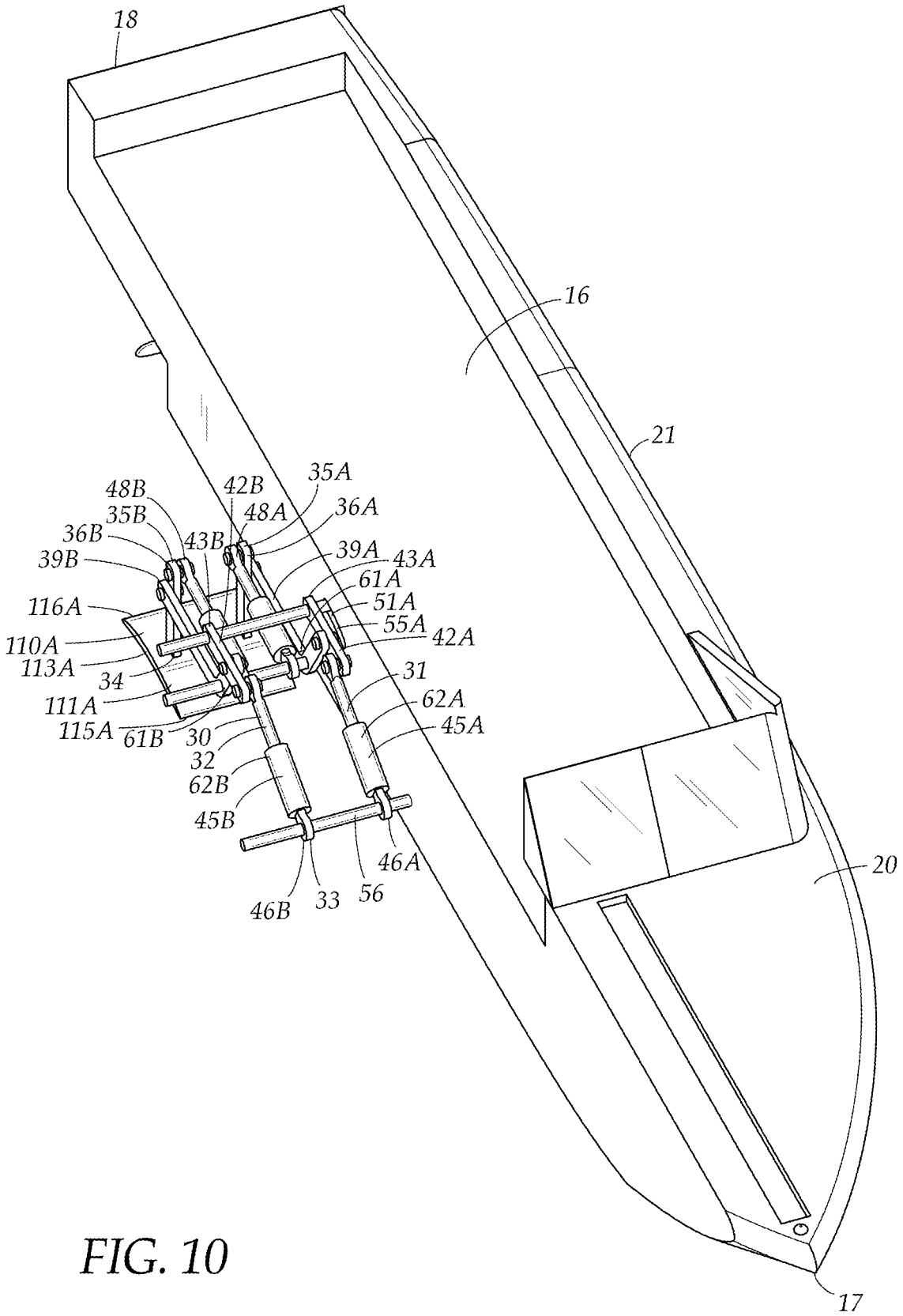
FIG. 10 shows a top perspective view of the boat wake enhancing device, illustrating the right assembly attached to the hull of a boat in accordance with one embodiment of the present disclosure.

Referring now to FIG. 6A, FIG. 6B, and FIG. 8B, while continuing to refer to FIG. 1, FIG. 2, FIG. 3, and FIG. 9, in embodiments, the tabs 110A, 110B may comprise a foiled shape, as shown in FIG. 6A and FIG. 6B. In this way, the first regions 115A, 115B comprise a rounded front edge 120A, 120B and the second regions 116A, 116B comprise a tail 121A, 121B with a pointed edge 122A, 122B. In embodiments, the rounded front edges 120A, 120B include a greater height than the tails 121A, 121B. The top surfaces 111A, 111B curve downwardly from the apex 117A, 117B between the rounded front edges 120A, 120B and the tails 121A, 121B. The bottom surfaces 112A, 112B taper between the rounded front edges 120A, 120B and the tails 121A, 121B in a substantially linear fashion. This enables the tabs 110A, 110B to efficiently create lift and downforce upon the boat 20, thereby enabling better control of the height, length, and shape of the wakes.

Referring back to FIG. 4, FIG. 5A, and FIG. 5B, while continuing to refer to FIG. 2, FIG. 3, FIG. 6A, FIG. 6B, and FIG. 9, in embodiments, the first actuator arm 71 and the second actuator arm 72 of the left assembly 70 are substantially identical to the first actuator arm 31 and the second actuator arm 32 of the right assembly 30. The first actuator arm 31 and the second actuator arm 32 of the right assembly 30 are substantially identical. The first actuator arm 31 and the second actuator arm 32 translate in tandem between the open position 12 and the closed position 11. The first actuator arm 31 comprises a group of arms 35A and a group of pistons 62A. In embodiments, the group of arms 35A each include a first arm 36A with an upper end 37A and a lower end 38A, a second arm 39A with an upper end 40A and a lower end 41A, and a third arm 42A with an upper end 43A and a lower end 44A. In embodiments, the group of arms 35A comprise more than three arms. In embodiments, the group of arms 35A comprise less than three arms. The lower end 38A of the first arm 36A is coupled to the top surface 111A of the first tab 110A. The first arm 36A extends upwardly, perpendicular from the first tab 110A. The lower end 41A of the second arm 39A is coupled to the upper end 37A of the first arm 36A and the upper end 40A of the second arm 39A is coupled to a center region 60A of the third arm 42A. In embodiments, the second arm 39A curves upwardly at a middle region 61A between the upper end 37A of the first arm 36A and the center regions 60A of the third arm 42A. The third arm 42A extends between the back end 54 of the slot 51A and a first piston 45A. The second actuator arm 32 is identical to the first actuator arm 31, comprising a group of arms 35B identical in configuration and makeup as the group of arms 35A of the first actuator arm 31. The group of arms 35A, 35B are interconnected such that the group of arms 35A, 35B translate simultaneously with each other 35A, 35B.

The group of pistons 62A of the first actuator arm 31 comprise the first piston 45A and a second piston 48A. In embodiments, the group of pistons 62A comprise more than two pistons. In embodiments, the group of pistons 62A comprise less than two pistons. The group of pistons 62A are configured to translate the group of arms 35A between the open position 12, the closed position 11, the downturned position 13, the neutral position 14, and the upturned position 15. The first piston 45A includes a first end 46A and a second end 47A. The second piston 48A includes a first end 49A and a second end 50A. The second end 47A of the first piston 45A is coupled to the lower end 44A of the third arm 42A. The second end 50A of the second piston 48A is coupled to the upper end 37A of the first arm 36A and the first end 49A of the second piston 48A is coupled near the middle region 61A of the second arm 39A. In embodiments, the first end 49A of the second piston 48A is coupled to the second arm 39A offset upwardly from the middle region 61A, towards the third arm 42A. The second actuator arm 32 is identical to the first actuator arm 31, comprising a group of pistons 62B identical in configuration and makeup as the group of arms 62A of the first actuator arm 31. In embodiments, the group of pistons 62A, 62B comprise any mechanical mechanism which translates the group of arms 35A, 35B between the open position 12, the closed position 11, the downturned position 13, the neutral position 14, and the upturned position 15.

The right assembly 30 further includes a group of horizontal arms 56 configured to attach the right assembly 30 to the boat 20. In embodiments, the group of horizontal arms 56 comprise a first horizontal arm 57, a second horizontal arm 58, and a third horizontal arm 59. In embodiments, the group of horizontal arms 56 comprise more than three horizontal arms. In embodiments, the group of horizontal arms 56 comprise less than three horizontal arms. The first horizontal arm 57 extends perpendicularly between the left side wall 26A and the right side wall 27A of the first interior cavity 25A, the first ends 46A, 46B of the first pistons 45A, 45B are coupled to the first horizontal arm 57. The second horizontal arm 58 extends perpendicularly between the first slot 51A and the second slot 51B, such that the second horizontal arm 58 is fastened to the tracks 55A, 55B of the first slot 51A and the second slot 51B. In this way, the second horizontal arm 58 can easily translate along the tracks 55A, 55B. The upper ends 43A, 43B of the third arms 42A, 42B are coupled to the second horizontal arm 58. In this way, as the third arms 42A, 42B translate between the open position 12 and the closed position 11, the second horizontal arm 58 translates accordingly and simultaneously within the tracks 55A, 55B. The third horizontal arm 59 extends perpendicularly between the left side wall 26A and the right side wall 27A of the first interior cavity 25A, the first ends 49A, 49B of the second pistons 48A, 48B and the middle region 61A, 61B of the second arms 39A, 39B are coupled to the third horizontal arm 59.

The left assembly 70 is substantially identical to the right assembly 30, such that the first actuator arm 71 and the second actuator arm 72 of the left assembly 70 are identical to the first actuator arm 31 and the second actuator arm 32 of the right assembly 30. In this way, the first actuator arm 71 and the second actuator arm 72 of the left assembly 70 each comprise a group of arms 75A, 75B and a group of pistons 100A, 100B identical in make and configuration of the group of arms 35A, 35B and the group of pistons 62A, 62B of the first actuator arm 31 and the second actuator arm 32 of the right assembly 30. The left assembly 70 further includes a group of horizontal arms 96 identical in make and configuration as the group of horizontal arms 56 of the right assembly 30. In this way, the left assembly 70 appears and performs the identical function as the right assembly 30.

In operation of embodiments, the boat wake enhancing device 10 is engaged by translating the right assembly 30 and the left assembly 70 from the closed position 11 to the open position 12. The first actuator arm 31 and the second actuator arm 32 of the right assembly 30 transition from the closed position 11 to the open position 12 simultaneously and in identical manners. To transition the first actuator arm 31 of the right assembly 30 from the closed position 11 to the open position 12, the second end 47A the first piston 45A translates upwardly, pivoting upwardly around the first horizontal arm 57, thereby engaging the third arm 42A. This translates the lower end 44A of the third arm 42A upward. In this way, the upper end 43A of the third arm 42A is pushed towards the stern 18 of the boat 20, thereby causing the second horizontal arm 58 to translate backwards, toward the stern 18 of the boat 20. The second horizontal arm 58 translates across the track 55A of the slot 51A towards the back end 54A of the slot 51A. This causes the lower end 41A of the second arm 39A to translate downward until the lower end 41A of the second arm 39A is substantially perpendicular to the first arm 36A. In this way, the first arm 36A and the first tab 110A translate downward, into the water below the first interior cavity 25A thereby positioning the boat wake enhancing device 10 into the open position 12. The first actuator arm 71 and the second actuator arm 72 of the left assembly 70 transition from the closed position 11 to the open position 12 in the same manner as the first actuator arm 31 and the second actuator arm 32 of the right assembly 30.

In operation of embodiments, the boat wake enhancing device 10 is disengaged by translating the right assembly 30 and the left assembly 70 from the open position 12 to the closed position 11. The first actuator arm 31 and the second actuator arm 32 of the right assembly 30 transition from the open position 12 to the closed position 11 simultaneously and in identical manners. To transition the first actuator arm 31 of the right assembly 30 from the closed position 11 to the open position 12, the second end 47A of the first piston 45A translate downwardly, pivoting downwardly around the first horizontal arm 57, thereby engaging the third arm 42A. This translates the lower end 44A of the third arm 42A downwardly. In this way, the upper end 43A of the third arm 42A is pulled towards the bow 17 of the boat 20, thereby causing the second horizontal arm 58 to translate forward, towards the bow 17 of the boat 20. The second horizontal arm 58 translates across the track 55A of the slot 51A, towards the front end 53A of the slot 51A. This causes the lower end 41A of the second arm 39A to translate upward until the lower end 38A of the first arm 36A and the first tab 110A are entirely housed within the first interior cavity 25A, thereby positioning the boat wake enhancing device 10 into the closed position 11. The first actuator arm 71 and the second actuator arm 72 of the left assembly 70 transition from the open position 12 to the closed position 11 in the same manner as the first actuator 31 and the second actuator 32 of the right assembly 30.

Figure 5A:
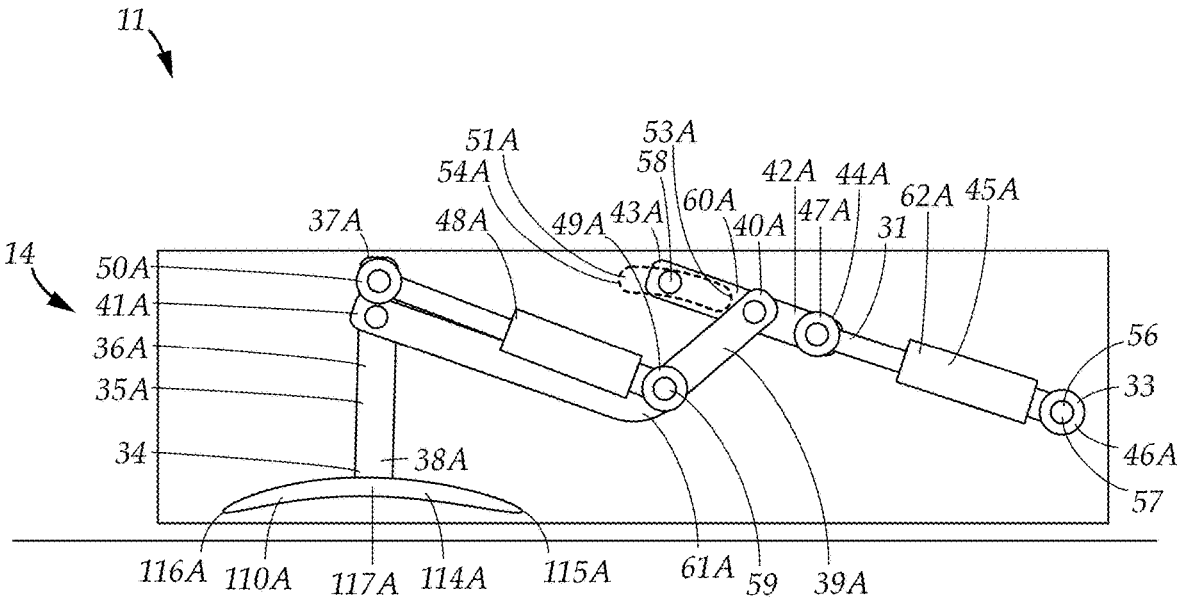
FIG. 5A shows a side plan view of the boat wake enhancing device, illustrating the first actuator arm of the right assembly in the closed position in accordance with one embodiment of the present disclosure.
Figure 5B:
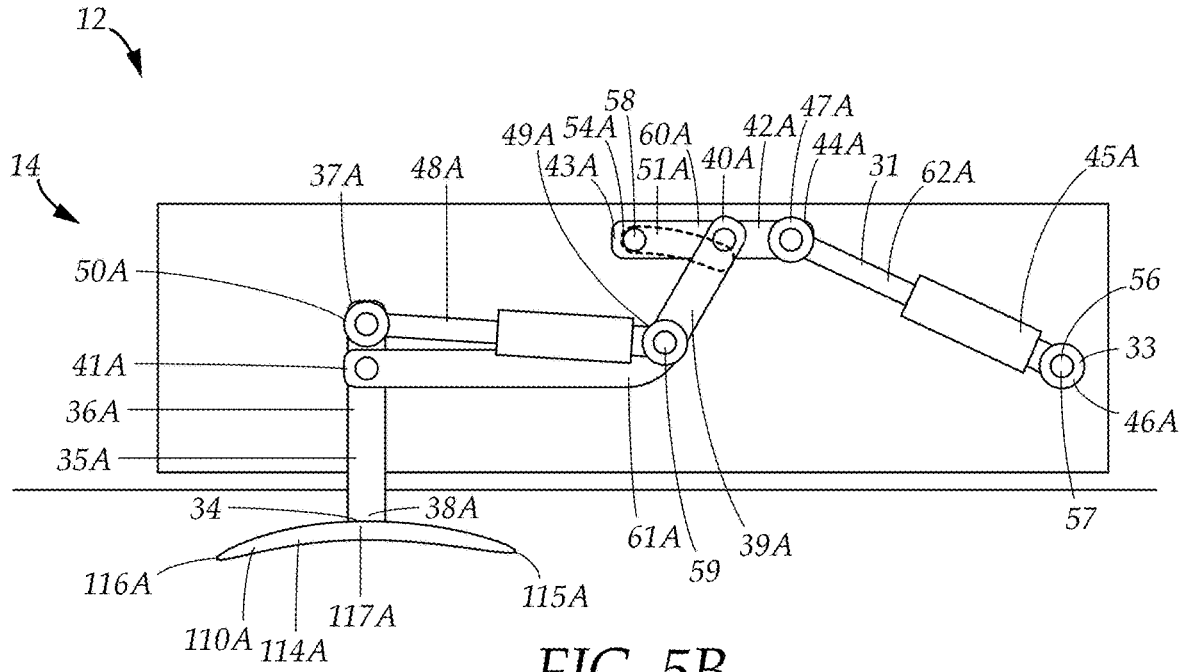
FIG. 5B shows a side plan view of the boat wake enhancing device, illustrating the first actuator arm of the right assembly attached to the hull of a boat in the open position in accordance with one embodiment of the present disclosure.

Referring back to FIG. 1, FIG. 6A, FIG. 6B, and FIG. 10, while continuing to refer to FIG. 5A and FIG. 5B, the tabs 110A, 110B may transition between the neutral position 14, the downturned position 13, and the upturned position 15 when the boat wake enhancing device 10 is in the open position 12. The neutral position 14 enables the boat wake enhancing device 10 to better stabilize the boat 20. In this position, the first arms 36A, 36B are substantially perpendicular to the second arms 39A, 39B. In this way, the tabs 110A, 110B are positioned directly below the boat 20, not angled forwards or backwards. The downturned position 13 enables the boat wake enhancing device 10 to create additional downforce on the stern 18 of the boat 20, this results in the stern 18 of the boat 20 being pulled further downward into the water and the bow 17 of the boat 20 being pushed further upward out of the water. This creates additional water displacement around the stern 18 of the boat 20, thereby creating larger wakes for wake boarding sports. In this position, the first arms 36A, 36B are angled outwardly, away from the second arms 39A, 39B, towards the stern 18 of the boat 20. The upturned position 15 enables the boat wake enhancing device 10 to create additional lift on the stern 18 of the boat 20, this results in the stern 18 of the boat 20 being pushed further upward out of the water and the bow 17 of the boat 20 being pulled further downward into the water. This offsets some of the weight in the stern 18 of the boat 20, thereby creating smaller wakes for wake boarding sports. In this position, the first arms 36A, 35B are angled inwardly, towards the second arms 39A, 39B and the bow 17 of the boat 20.

Figure 3:
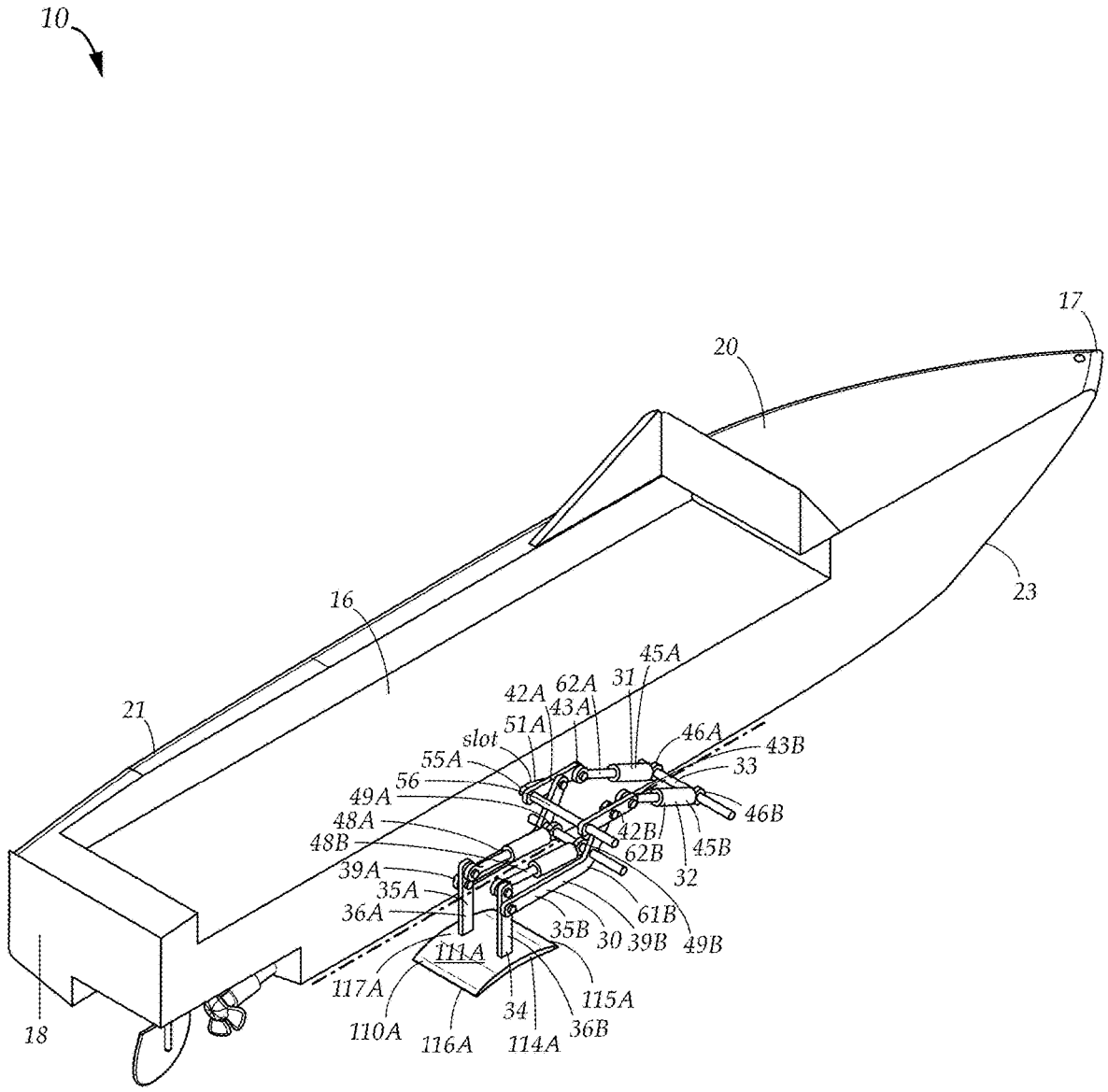
FIG. 3 shows a top perspective view of the boat wake enhancing device, illustrating the right assembly attached to the hull of a boat in accordance with one embodiment of the present disclosure.
Figure 4:
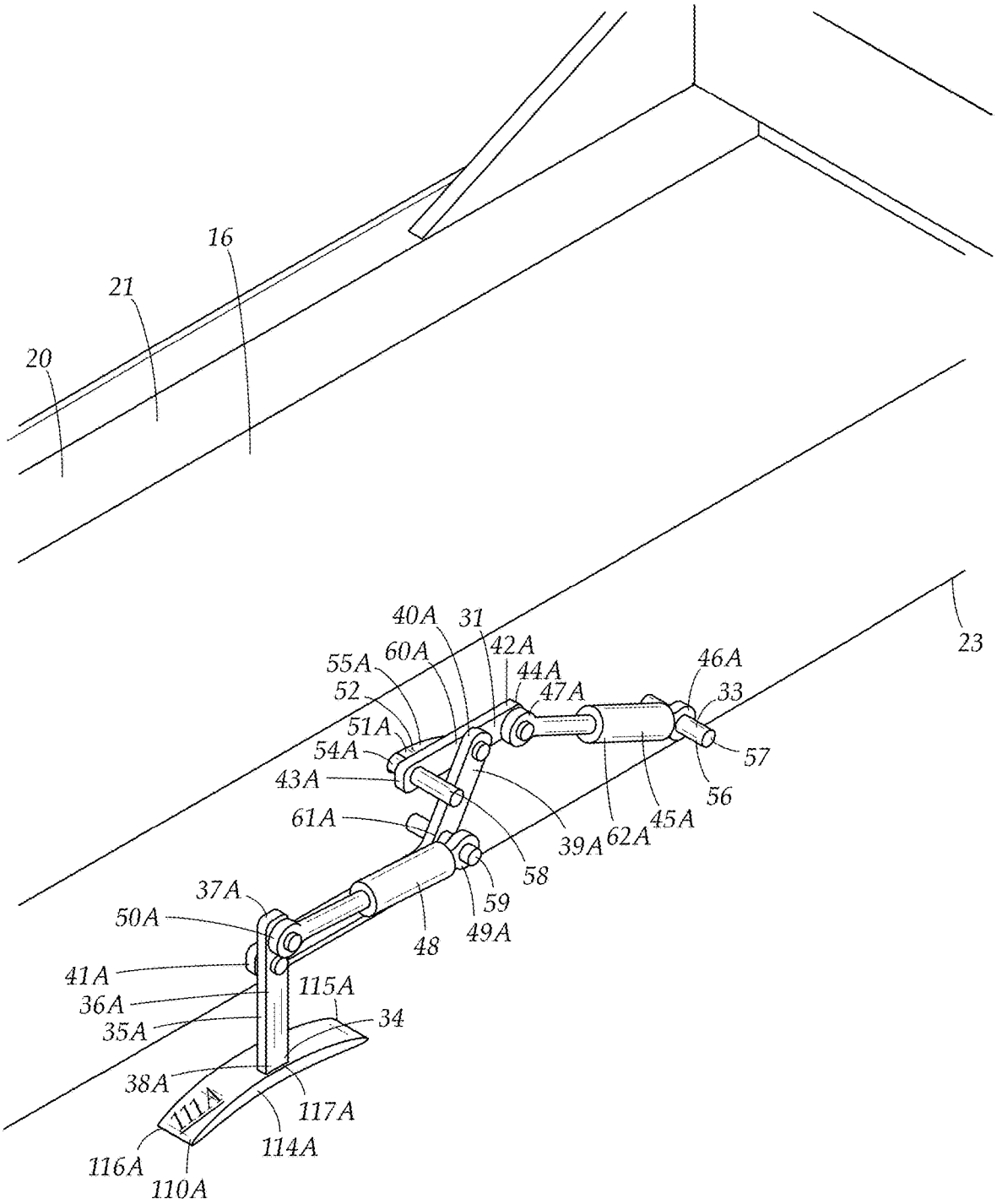
FIG. 4 shows a perspective view of the boat wake enhancing device, illustrating the first actuator arm of the right assembly attached to the hull of a boat in accordance with one embodiment of the present disclosure.
Figure 7A:
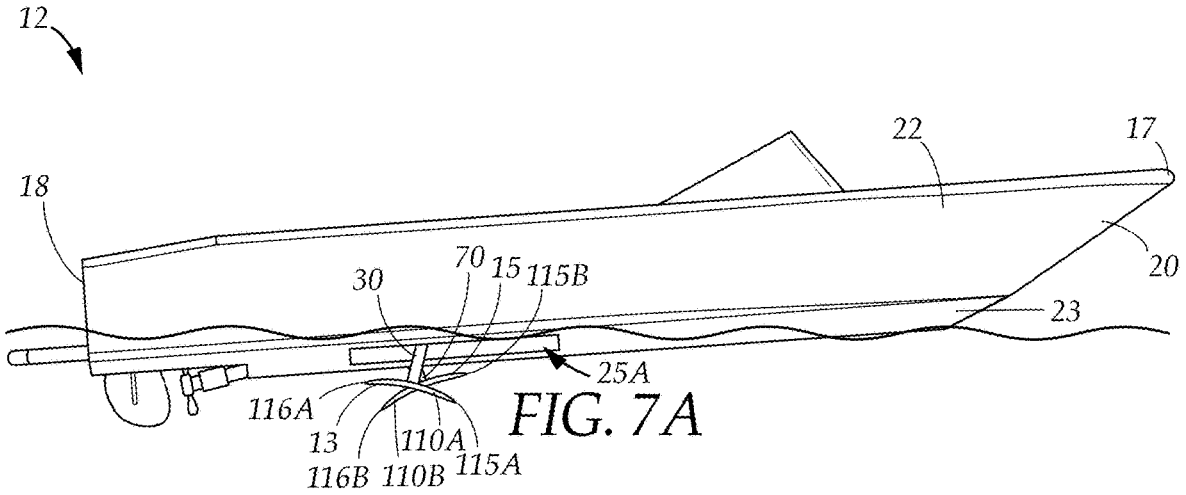
FIG. 7A shows a side view of the boat wake enhancing device, illustrating the right assembly in the downturned position and the left assembly in the upturned position in accordance with one embodiment of the present disclosure.
Figure 7B:
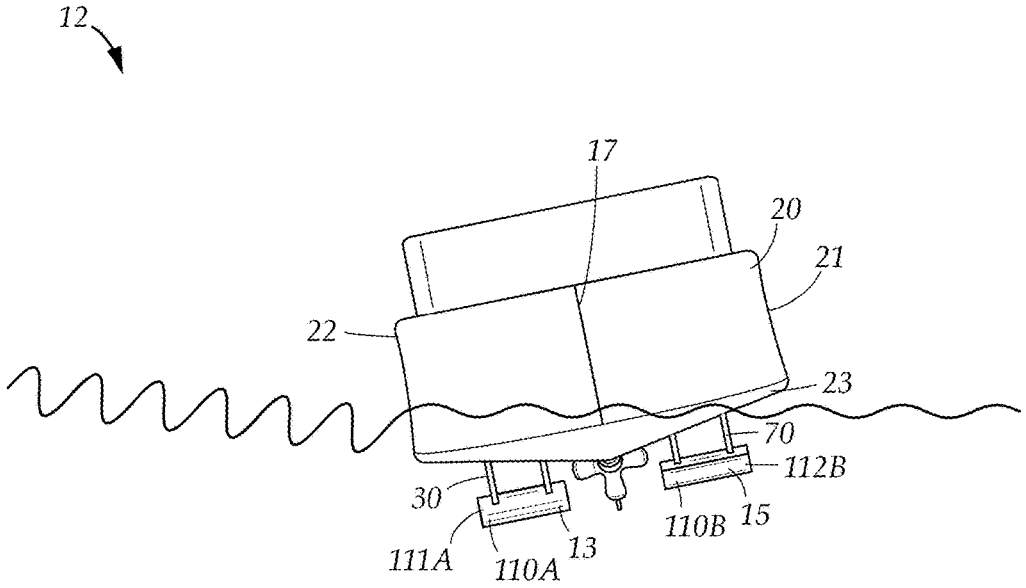
FIG. 7B shows a front view of the boat wake enhancing device, illustrating the right assembly in the downturned position and the left assembly in the upturned position in accordance with one embodiment of the present disclosure.

Referring now to FIG. 3, FIG. 7A, and FIG. 7B, while continuing to refer to FIG. 5A, FIG. 5B, FIG. 6A, FIG. 6B, and FIG. 9, the first actuator arm 31 of the right assembly 30 transitions into the downturned position 13 by first engaging the second piston 48A such that the second piston 48A retracts towards the bow 17 of the boat 20, thereby causing the upper end 37A of the first arm 36A to pivot inwardly with the second end 50A of the second piston 48A. This translates the first arm 36A backwards, towards the stern 18 of the boat 20 such that the upper end 37A of the first arm 36A translates forward towards the bow 17 of the boat 20 and the lower end 38A of the first arm 36A translates backwards towards the stern 18 of the boat 20. In this way, the first tab 110A translates backwards towards the stern 18 of the boat 20 and is angled downwardly, such that the first region 115A is positioned lower than the second region 116A. This downturned position 13 enables the current of the water to push onto the top surface 111A of the tab 110A, thereby creating downforce which pulls the stern 18 of the boat 20 downward deeper into the water. The first actuator arm 71 and the second actuator arm 72 of the left assembly 70 and the second tab 110B transitions into the downturned position 13 in an identical manner as the first actuator arm 31 and the second actuator arm 32 of the right assembly 30 and the first tab 110A.

The first actuator arm 31 of the right assembly 30 transitions into the upturned position 15 by first engaging the second piston 48A such that the second piston 48A protracts towards the stern 18 of the boat 20 thereby causing the upper end 37A of the first arm 36A to pivot outwardly with the second end 50A of the second piston 48A. This translates the first arm 36A forwards, toward the bow 17 of the boat 20. In this way, the tab 110A translates forward towards the bow 17 of the boat 20 and is angled upwardly, such that the second region 116A is positioned lower than the first region 115A. This upturned position 15 enables the current of the water to push onto the bottom surface 112A of the tab 110A, thereby creating lift which pushes the stern 18 of the boat 20 upward towards the surface of the water. The first actuator arm 71 and the second actuator arm 72 of the left assembly 70 and the second tab 110B transitions into the upturned position 15 in an identical manner as the first actuator arm 31 and the second actuator arm 32 of the right assembly 30 and the first tab 110A.

Figure 2:
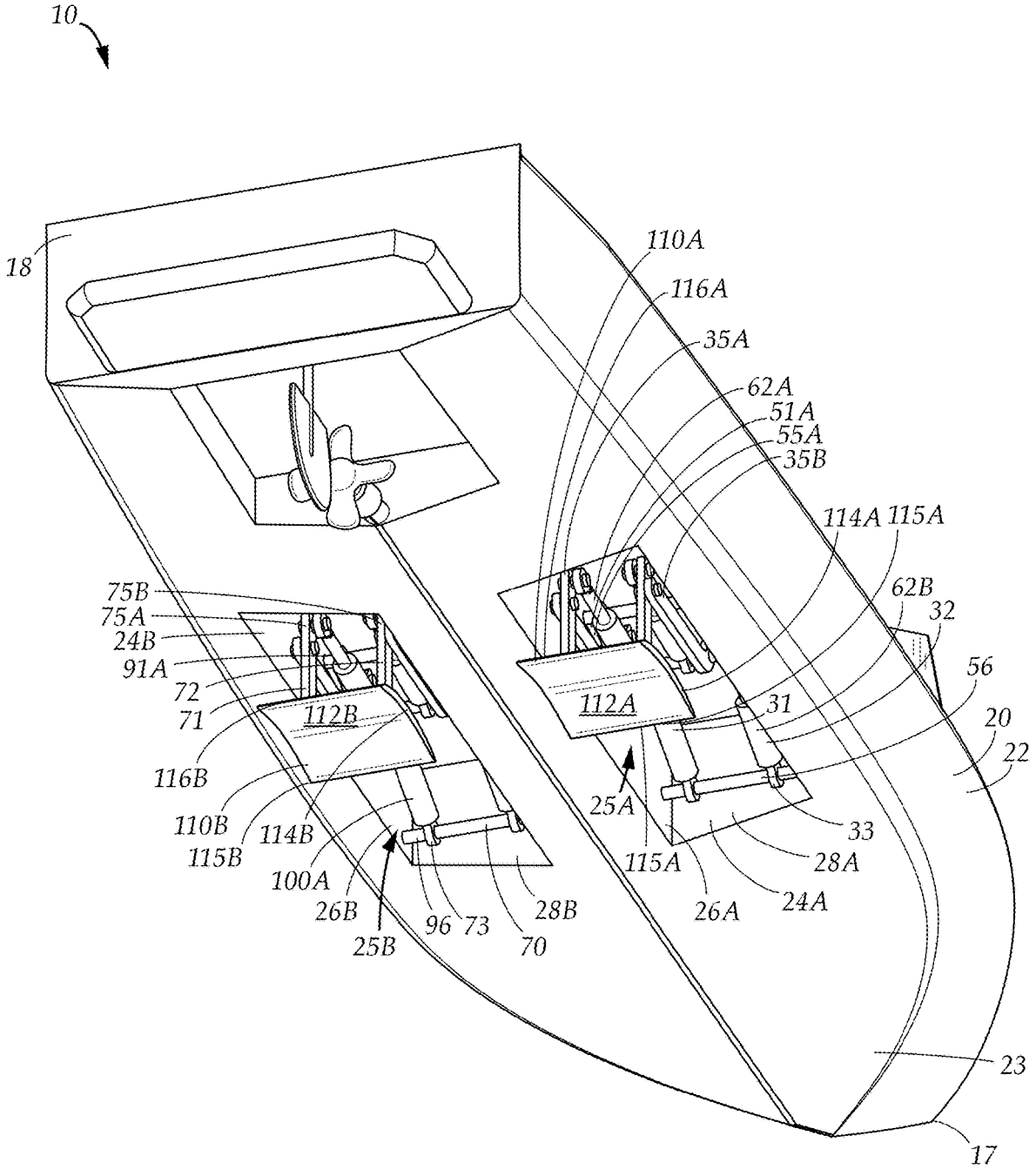
FIG. 2 shows a bottom perspective view of the boat wake enhancing device, illustrating the boat wake enhancing device mounted to the hull of a boat in an open position in accordance with one embodiment of the present disclosure.

Referring now to FIG. 2, FIG. 8A, and FIG. 8B, while continuing to refer to FIG. 3, FIG. 5A, FIG. 5B, and FIG. 9, the first actuator arm 31 of the right assembly 30 transitions into the neutral position 14 by engaging the second piston 48A such that the second piston 48A protracts towards the stern 18 of the boat 20 or retracts towards the bow 17 of the boat 20. This causes the upper end 37A of the first arm 36A to pivot with the second end 50A of the second piston 48A. This translates the first arm 36A to be perpendicular to both the lower end 41A of the second arm 39A and the apex 117A of the tab 110A. In this way, the tab 110A translates so the apex 117A is parallel with the deck 16 of the boat 20 and the first region 115A and the second region 116A of the tab 110A are positioned at substantially the same depth. This neutral position 14 enables the current of the water to evenly pass over the top surface 111A of the tab 110A and beneath the bottom surface 112A of the tab 110A, thereby enabling the tab 110A to better stabilize the boat 20. The first actuator arm 71 and the second actuator arm 72 of the left assembly 70 and the second tab 110B transitions into the neutral position 14 in an identical manner as the first actuator arm 31 and the second actuator arm 32 of the right assembly 30 and the first tab 110A.

In embodiments, the boat wake enhancing device 10 comprises more than two assemblies 30, 70. For example, in embodiments, the boat wake enhancing device 10 comprises four assemblies. A pair of assemblies identical to the left assembly 70 and the right assembly 30 are mounted to the bottom of the hull 23 of the boat 20 between the bow 17 and the midpoint of the stern 18 and the bow 17. In this way, the boat wake enhancing device 10 includes a pair of assemblies mounted to the bottom of the hull 23 between the stern 18 and the midpoint of the stern 18 and the bow 17 and a pair of assemblies mounted to the bottom of the hull 23 between the bow 17 and the midpoint of the stern 18 and the bow 17.

Referring now to FIG. 1. FIG. 7A, and FIG. 7B, while continuing to refer to FIG. 8A and FIG. 8B, in operation of embodiments, both the right assembly 30 and the left assembly 70 are deployed to the same position when in use. For example, both assemblies 30, 70 are deployed to the downturned position 13, the neutral position 14, or the upturned position 15 simultaneously. In other embodiments, the right assembly 30 and the left assembly 70 are deployed to different positions when in use. For example, the left assembly 70 is deployed in the upturned position 15 and the right assembly 30 is deployed in the downturned position 13. In embodiments, the boat wake enhancing device 10 comprises any material which does not corrode nor rust.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a boat wake enhancing device 10. The disclosure is illustrated by example in the drawing figures, and throughout the written description. It should be understood that numerous variations are possible, while adhering to the inventive concept. Such variations are contemplated as being a part of the present disclosure.

What is claimed is:

1. A boat wake enhancing device configured to create and control wakes generated by a boat having a deck and a hull with a bottom, the bottom of the hull having at least two apertures extending inwardly towards the deck defining at least two interior cavities, comprising:

a left assembly and a right assembly mounted to the bottom of the hull, the left assembly identical to the right assembly each including a top end, a bottom end, a first actuator arm, and a second actuator arm, the assemblies configured to translate between an open position and a closed position, the top end of the left assembly and the top end of the right assembly are mounted to the hull of the boat, the bottom end of the left assembly and the bottom end of the right assembly are coupled to a tab;

a pair of tabs, one of the tabs is coupled to the bottom end of the left assembly, and the other of the tabs are coupled to the bottom end of the right assembly, the tabs configured to create or enhance a wake including a top surface, a bottom surface opposite the top surface, a first side wall, and a second side wall opposite the first side wall, the first side wall and the second side wall extending perpendicularly between the top surface and the bottom surface, the tabs configured to translate between a downturned position, a neutral position, and an upturned position;

the first interior cavity is configured to house the right assembly, the second interior cavity is configured to house the left assembly, each interior cavity includes a left side wall, a right side wall parallel to the left side wall, a front wall, and a back wall parallel to the front wall, the left side wall and the right side wall interconnect the front wall and the back wall, the tabs are selectively retracted into the interior cavities such that the boat wake enhancing device is fully housed within the interior cavities when in the closed position, the tabs protrude below the interior cavities such that the bottom end of the left assembly, the bottom end of the right assembly, and the tabs are selectively submerged in the water below the bottom of the hull when in the open position and the tabs may translate between the downturned position, the neutral position, and the upturned position; wherein the actuator arms of the left assembly and the right assembly each include a group of arms comprising a first arm, a second arm, and a third arm, each of the arms include an upper end and a lower end, the second arm further includes a middle region, the third arm further includes a center region;

the actuator arms of the left assembly and the right assembly each include a group of pistons comprising a first piston and a second piston each of the pistons include a first end and a second end;

the side walls of the interior cavities further including a slot configured to aid in translating the left assembly and the right assembly between the open position and the closed position, the slots comprising a cavity defining a track with a front end and a back end;

the lower end of the first arm coupled to the top surface of the tab and extends upwardly, perpendicularly from the tab, the lower end of the second arm coupled to the upper end of the first arm, the upper end of the second arm coupled to the center region of the third arm, the third arm extends between the slot and the first piston; and the second end of the first piston coupled to the lower end of the third arm, the first end of the second piston coupled to the middle region of the second arm, the second end of the second piston coupled to the upper end of the first arm.

2. The boat wake enhancing device of claim 1, wherein boat wake enhancing device transitions into the downturned position by engaging the second pistons such that the second pistons retract towards the bow of the boat, the upper ends of the first arms pivot inwardly with the second ends of the second pistons thereby translating the first arms backwards towards the stern such that the upper ends of the first arms translate forward towards the bow and the lower ends of the first arms translate backwards towards the stern, the tabs translate backwards towards the stern, angled downwardly such that the first regions are positioned lower than the second regions.

3. The boat wake enhancing device of claim 1, wherein the boat wake enhancing device transitions into the upturned position by engaging the second pistons such that the second pistons protract towards the stern of the boat, the upper ends of the first arms pivot outwardly with the second ends of the second pistons thereby translating the first arms forwards towards the bow such that the upper ends of the first arms translate backward towards the stern and the lower ends of the first arms translate forwards towards the bow, the tabs translate forwards towards the bow, angled upwardly such that the second regions are positioned lower than the first regions.

4. The boat wake enhancing device of claim 1, wherein the boat wake enhancing device transitions into the neutral position by translating the first arms to be perpendicular to both the lower ends of the second arms and the apex of the tab, this translates the tab so that the apex is parallel to the deck of the boat and the first regions and the second regions are positioned at substantially the same depth.

5. The boat wake enhancing device of claim 1, wherein the second arm curves upwardly at the middle region between the upper end of the first arm and the center region of the third arm.

6. The boat wake enhancing device of claim 1, wherein the left assembly and the right assembly each further include a group of horizontal arms configured to attach the assemblies to the boat comprising a first horizontal arm extending perpendicularly between the left side wall and the right side wall of the interior cavity, a second horizontal arm extending perpendicularly between the tracks of the first slot and the tracks of the second slot, and a third horizontal arm extending perpendicularly between the left side wall and the right side wall of the interior cavity.

7. The boat wake enhancing device of claim 6, wherein the first end of the first piston of the first actuator arm and the second actuator arm coupled to the first horizontal arm, the upper end of the third arm of the first actuator arm and the second actuator arm coupled to the second horizontal arm, the first end of the second piston and the middle region of the second arm of the first actuator arm and the second actuator arm coupled to the third horizontal arm.

8. The boat wake enhancing device of claim 7, wherein the boat wake enhancing device transitions from the closed position to the open position by:

translating the second ends of the first pistons upwardly, the first pistons pivot upwardly around the first horizontal arm thereby engaging the third arms, the lower ends of the third arms translate upwardly causing the second horizontal arm to translate towards the stern of the boat, the second horizontal arm translates across the tracks of the slots towards the back ends of the slots, this translates the lower ends of the second arms downward until the lower ends of the second arms are substantially perpendicular to the first arms thereby translating the tabs downward away from the interior cavity into the water below the interior cavity.

9. The boat wake enhancing device of claim 7, wherein the boat wake enhancing device transitions from the open position to the closed position by:

translating the second ends of the first pistons downwardly, the first pistons pivot downwardly around the first horizontal arm thereby engaging the third arms, the lower ends of the third arms translate downwardly causing the second horizontal arm to translate towards the bow of the boat, the second horizontal arm translates across the tracks of the slots towards the front ends of the slots, this translates the lower ends of the second arms upward until the lower ends of the first arms and the tabs are entirely housed within the interior cavity.

10. The boat wake enhancing device of claim 1, wherein the tabs further include a first region, a second region opposite the first region, and an apex, the apex coupled to the first actuator arm and the second actuator arm, the tab curves outwardly, downward from the apex towards the first region and the second region.

11. The boat wake enhancing device of claim 1, wherein the tabs comprise a foiled shape including a rounded front edge and a tail with a pointed edge opposite the rounded front edge.

12. The boat wake enhancing device of claim 11, wherein the rounded front edge includes a greater height than the tail, the top surface curves downwardly from the apex to the rounded front edge and the tail, the bottom surface extends in a substantially linear fashion between the rounded front edge and the tail, the top surface and the bottom surface converge at the tail.

13. The boat wake enhancing device of claim 1, wherein:

the neutral position enables the boat wake enhancing device to stabilize the boat, in the neutral position the first arms are substantially perpendicular to the second arms and the tabs;

the downturned position enables the boat wake enhancing device to create additional downforce on the stern of the boat, thereby pulling the stern of the boat further downward into the water and pushing the bow of the boat further upward out of the water thus creating larger wakes, in the downturned position the first arms are angled outwardly away from the second arms towards the stern of the boat;

the upturned position enables the boat wake enhancing device to create additional lift on the stern, thereby pushing the stern of the boat further upward towards the surface of the water and pulling the bow of the boat downward into the water thus creating smaller wakes, in the upturned position the first arms are angled inwardly, towards the second arms and the bow of the boat.

14. The boat wake enhancing device of claim 1, wherein the left assembly and the right assembly are deployed identically, such that both tabs are in the same position.

15. The boat wake enhancing device of claim 1, wherein the left assembly and the right assembly are deployed to different positions, such that each tab comprises a different position.

* * * * *